US010299579B2

(12) United States Patent
Jimenez

(10) Patent No.: US 10,299,579 B2
(45) Date of Patent: May 28, 2019

(54) ORAL CARE IMPLEMENT HAVING COLLAPSIBLE ELASTOMERIC ELEMENT

(71) Applicant: COLGATE-PALMOLIVE COMPANY, New York, NY (US)

(72) Inventor: Eduardo Jimenez, Manalapan, NJ (US)

(73) Assignee: Colgate-Palmolive Company, New York, NY (US)

( * ) Notice: Subject to any disclaimer, the term of this patent is extended or adjusted under 35 U.S.C. 154(b) by 282 days.

(21) Appl. No.: 15/506,702

(22) PCT Filed: Aug. 28, 2014

(86) PCT No.: PCT/US2014/053064
§ 371 (c)(1),
(2) Date: Feb. 24, 2017

(87) PCT Pub. No.: WO2016/032472
PCT Pub. Date: Mar. 3, 2016

(65) Prior Publication Data
US 2017/0245631 A1 Aug. 31, 2017

(51) Int. Cl.
*A46B 15/00* (2006.01)
*A46B 9/04* (2006.01)
*A46B 5/02* (2006.01)

(52) U.S. Cl.
CPC ..... *A46B 15/0055* (2013.01); *A46B 5/02* (2013.01); *A46B 9/04* (2013.01); *A46B 2200/108* (2013.01); *A46B 2200/1026* (2013.01); *A46B 2200/1066* (2013.01)

(58) Field of Classification Search
CPC ..... A46B 15/0055; A46B 15/0069; A46B 5/02; A46B 9/04; A46B 2200/1026; A46B 2200/1066; A46B 2200/108; A61H 13/00
USPC ..... 15/110, 167.1
See application file for complete search history.

(56) References Cited

U.S. PATENT DOCUMENTS 2,045,939 A 6/1936 Blanchard
2,141,969 A * 12/1938 Benz ..... A46B 15/0055 15/110
2,154,846 A * 4/1939 Heymann ..... A61H 13/00 15/110
2,164,219 A * 6/1939 McGerry ..... A61H 13/00 15/110
2,827,045 A 10/1956 Diener
2,790,441 A * 4/1957 Oderman ..... A61H 13/00 15/110
2,798,241 A 7/1957 Cohen
(Continued)

OTHER PUBLICATIONS

International Search Report and the Written Opinion of the International Searching Authority issued in international application PCT/US2014/053064 dated Apr. 23, 2015.

*Primary Examiner* — Weilun Lo

(57) ABSTRACT

An oral care implement having a collapsible elastomeric element. The oral care implement may include a body having a handle portion and a head portion. Furthermore, an elastomeric element may extend from the body. The elastomeric element may comprise a hollow body that has an internal cavity, the hollow body having a base section, a middle section, and a distal section that includes a free distal tip, each of the base, middle, and distal sections coupled together by a pre-weakened section. The elastomeric element may be configured to alternate between a collapsed state and a normal state.

17 Claims, 7 Drawing Sheets

(56) References Cited

U.S. PATENT DOCUMENTS

| | | | | | |
|---|---|---|---|---|---|
| 2,888,008 | A | * | 5/1959 | Rosenthal | A61H 13/00 132/309 |
| 3,553,759 | A | | 1/1971 | Kramer et al. | |
| 3,677,264 | A | | 7/1972 | Brockman | |
| 4,115,893 | A | * | 9/1978 | Nakata | A46B 3/005 15/110 |
| 4,543,679 | A | | 10/1985 | Rosofsky et al. | |
| 4,653,480 | A | * | 3/1987 | Rabinowitz | A61H 13/00 601/141 |
| 4,670,931 | A | | 6/1987 | Abbassi | |
| 4,683,875 | A | * | 8/1987 | Rabinowitz | A61H 13/00 601/141 |
| 4,724,570 | A | | 2/1988 | Hitzman | |
| D296,271 | S | | 6/1988 | Kobayashi | |
| 4,879,781 | A | | 11/1989 | Desimone | |
| 4,913,133 | A | * | 4/1990 | Tichy | A61C 17/20 433/142 |
| 5,119,803 | A | * | 6/1992 | Fishman | A61C 19/063 433/80 |
| 5,205,302 | A | | 4/1993 | Lemon et al. | |
| D350,440 | S | | 9/1994 | Lemon et al. | |
| 5,711,759 | A | * | 1/1998 | Smith | A61J 17/006 601/139 |
| 6,957,467 | B2 | | 10/2005 | Cabedo-Deslierres et al. | |
| 6,993,804 | B1 | | 2/2006 | Braun et al. | |
| 7,827,644 | B2 | | 11/2010 | Eliav | |
| 2001/0054211 | A1 | * | 12/2001 | Cabedo-Deslierres | A46B 5/0016 15/106 |
| 2004/0237226 | A1 | | 12/2004 | Hohlbein et al. | |
| 2007/0163064 | A1 | | 7/2007 | Wong et al. | |

* cited by examiner

ORAL CARE IMPLEMENT HAVING COLLAPSIBLE ELASTOMERIC ELEMENT

BACKGROUND

Toothbrushes are generally used to clean a user's teeth and gums with bristles that are coupled to a head of the toothbrush. Oral care implements that include a stimulator tip for inducing blood flow in a user's gums and other oral tissue surfaces are also sometimes used for oral care. Furthermore, toothbrushes that include both bristles and a stimulator tip have heretofore been known and used in the oral care industry. However, stimulator tips that are currently on the market are relatively rigid structures such that if a user applies the stimulator tips to his or her gums with excessive force, the user may damage his or her gums. Furthermore, because these stimulator tips are typically provided on the handle of a toothbrush, they can dig into a user's hand during toothbrushing. Thus, a need exists for an oral care implement that includes a stimulator tip that does not suffer from the drawbacks noted above and that is more comfortable to use.

BRIEF SUMMARY

The present invention is directed to an oral care implement having a collapsible elastomeric element. The oral care implement may include a handle and a head and a plurality of tooth cleaning elements extending from the head. Furthermore, an elastomeric element may extend from the handle. In one embodiment, the head may be coupled to a distal end of the handle and the elastomeric element may be located at a proximal end of the handle. The elastomeric element may comprise a hollow body that has an internal cavity, the hollow body having a base section, a middle section, and a distal section that includes a free distal tip, each of the base, middle, and distal sections coupled together by a pre-weakened section. The elastomeric element may be configured to alternate between a collapsed state and a normal state. In the collapsed state the middle section collapses into the internal cavity and is surrounded by the base section and the distal section collapses into the internal cavity so as to be at least partially surrounded by the middle section. In the normal state the middle section axially extends from the base section and the distal section axially extends from the middle section. The elastomeric element may be biased into the normal state and transition into the collapsed state in response to the application of an axial force onto the distal tip in a direction toward the handle. In one embodiment, the elastomeric element may be transitioned into one of the normal and collapsed states and may remain in that state until user force transitions the elastomeric element into the other of the normal and collapsed states.

In one aspect, the invention can be an oral care implement comprising: a body; an elastomeric element extending from the body and terminating in a free distal tip, the elastomeric element comprising a hollow body defining an internal cavity, the hollow body extending along a central axis; the hollow body comprising a base section coupled to the body, a distal section comprising the free distal tip, and at least one middle section located between the base and distal sections; and each of the base, middle and distal sections coupled to one another by a pre-weakened section, the elastomeric element configured to alternate between: (1) a collapsed state in which the middle section collapses into the internal cavity so as to be at least partially surrounded by the base section and the distal section collapses into the central cavity so as to be at least partially surrounded by the middle section upon the application of an axial force to the free distal tip in a first axial direction toward the handle portion; and (2) a normal state in which the middle section axially extends from the base section and the distal section axially extends from the middle section upon cessation of the axial force.

In another aspect, the invention can be an oral care implement comprising: a body comprising a handle portion and a head portion; an elastomeric element extending from the body and terminating in a free distal tip, the elastomeric element comprising a hollow body formed of a resilient material and defining an internal cavity, the hollow body extending along a central axis; the hollow body comprising a base section coupled to the body, a distal section comprising the free distal tip, and at least one middle section located between the base and distal sections; and each of the base, middle and distal sections coupled to one another by a pre-weakened section, the elastomeric element configured to alternate, in response to application and cessation of an axial force, between: (1) a collapsed state in which the middle section collapses into the internal cavity so as to be at least partially surrounded by the base section and the distal section collapses into the central cavity so as to be at least partially surrounded by the middle section; and (2) a normal state in which the base, middle, and distal sections collectively form a conical structure.

In yet another aspect, the invention can be an oral care implement comprising: a body comprising a handle portion and a head portion; an elastomeric element extending from the body and terminating in a free distal tip, the elastomeric element comprising a hollow body formed of a resilient material and defining an internal cavity, the hollow body extending along a central axis; the hollow body comprising a base section coupled to the body, a distal section comprising the free distal tip, and at least one middle section located between the base and distal sections; and each of the base, middle, and distal sections coupled to one another by a pre-weakened section, the elastomeric element configured to alternate between: (1) a collapsed state in which the middle section collapses into the internal cavity so as to be at least partially surrounded by the base section and the distal section collapses into the internal cavity so as to be at least partially surrounded by the middle section; and (2) a normal state in which the base, middle, and distal sections collectively form a conical structure.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
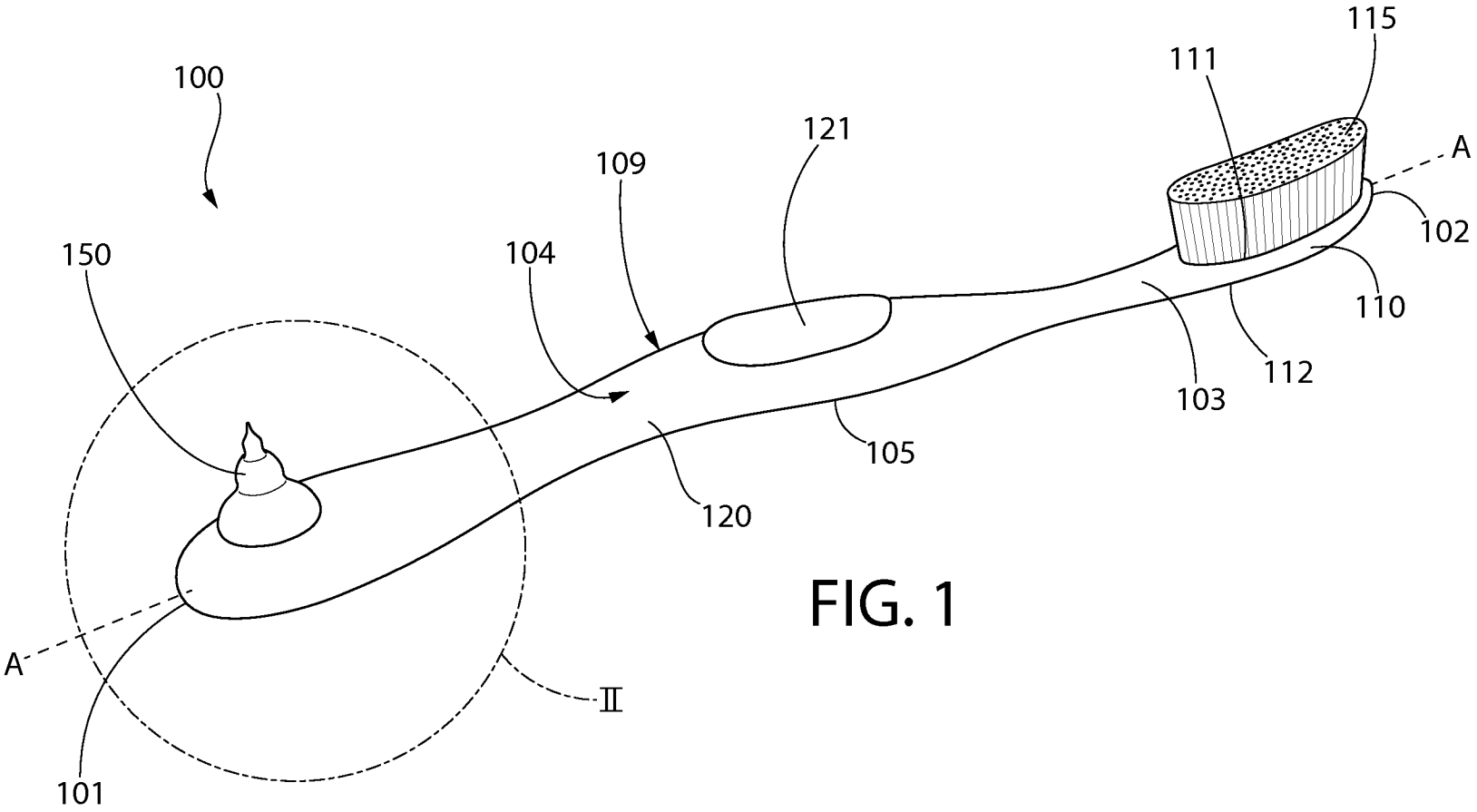
FIG. 1 is a front perspective view of an oral care implement having an elastomeric element in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring first to FIG. 1, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Thus, it is to be understood that the inventive concepts discussed herein can be applied to any type of oral care implement unless a specific type of oral care implement is specified in the claims.

The oral care implement 100 comprises a body 109 that extends from a proximal end 101 to a distal end 102 along a longitudinal axis A-A. The body 109 of the oral care implement 100 generally comprises a head portion 110 and a handle portion 120. The handle portion 120 of the body 109 extends from the proximal end 101 of the body 109 to a distal end 103. The head portion 110 of the body 109 is coupled to the distal end 103 of the handle portion 120 of the body 109. Furthermore, the handle portion 120 of the body 109 has a front surface 104 and an opposing rear surface 105.

The handle portion 120 of the body 109 is an elongated structure that provides the mechanism by which the user can hold and manipulate the oral care implement 100 during use. In the exemplified embodiment, the handle portion 120 is generically depicted having various contours for user comfort. Of course, the invention is not to be limited by the specific shape illustrated for the handle portion 120 in all embodiments and in certain other embodiments the handle portion 120 can take on a wide variety of shapes, contours, and configurations, none of which are limiting of the present invention unless so specified in the claims.

In the exemplified embodiment, the handle portion 120 is formed of a rigid plastic material, such as for example without limitation polymers and copolymers of ethylene, propylene, butadiene, vinyl compounds, and polyesters such as polyethylene terephthalate. The handle portion 120 also includes a grip 121 that is formed of a resilient/elastomeric material and that is molded over a portion of the handle portion 120 that is typically gripped by a user's thumb and forefinger during use. Furthermore, it should be appreciated that additional regions of the handle portion 120 can be overmolded with the resilient/elastomeric material to enhance the gripability of the handle portion 120 during use. For example, portions of the handle portion 120 that are typically gripped by a user's palm during use may be overmolded with a thermoplastic elastomer or other resilient material to further increase comfort to a user. Alternatively, the handle portion 120 can be free of grip-like elastomeric material overlays in other embodiments. Furthermore, materials other than those noted above can be used to form the handle portion 120, including metal, wood, or any other desired material that has sufficient structural rigidity to permit a user to grip the handle portion 120 and manipulate the oral care implement 100 during toothbrushing and other oral hygiene activities.

The head portion 110 of the oral care implement 100 is coupled to the handle portion 120 and comprises a front surface 111 and an opposing rear surface 112. In the exemplified embodiment, the head portion 110 is formed integrally with the handle portion 120 as a single unitary structure using a molding, milling, machining, or other suitable process. However, in other embodiments the handle portion 120 and the head portion 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus, the head portion 110 may, in certain embodiments, be formed of any of the rigid plastic materials described above as being used for forming the handle portion 120, although the invention is not to be so limited in all embodiments and other materials that are commonly used during toothbrush head manufacture may also be used.

In the exemplified embodiment, the oral care implement 100 also comprises a plurality of tooth cleaning elements 115 extending from the front surface 111 of the head portion 110. In the exemplified embodiment, the tooth cleaning elements 115 are generically illustrated as a plurality of tufts of bristles. The invention is not to be limited by the structure, pattern, orientation, and material of the tooth cleaning elements 115 in all embodiments. Thus, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, polybutylene terephthalate (PBT) bristles, spiral bristles, rubber bristles, elastomeric protrusions, flexible polymer protrusions, combinations thereof, and/or structures containing such materials or combinations. Thus, any combination of these tooth cleaning elements may be used within the tooth cleaning elements 115 in some embodiments. Furthermore, the tooth cleaning elements 115 may include one or more bristles that are either tapered, end-rounded, or spiral, and one or more tooth cleaning elements formed of an elastomeric material. In one particular embodiment of the present invention, the plurality of tooth cleaning elements 115 comprises at least one bristle tuft. Furthermore, in some embodiments the oral care implement 100 may not have any tooth cleaning elements, as will be appreciated from the discussion below.

In embodiments that use elastomeric materials to form one or more of the tooth cleaning elements 115, suitable elastomeric materials may include any biocompatible resilient material suitable for uses in an oral hygiene apparatus. To provide optimum comfort as well as cleaning benefits, the elastomeric material of any such tooth cleaning element may have a hardness property in the range of A10 to A70 Shore hardness in one embodiment, or A8 to A25 Shore hardness in another embodiment. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 115 may be coupled to the head portion 110 in any manner known in the art, including staples, in-mold tufting (IMT), anchor-free tufting (AFT), or a modified AFT known as AMR. In AFT the tooth cleaning elements 115 are coupled to a head plate that is formed separately from the body 109 of the oral care implement. The rear ends of the tooth cleaning elements 115 are heated to melt, and upon hardening the heated rear ends of the tooth cleaning elements 115 form a melt matte that secures the tooth cleaning elements 115 to the head plate. Next, the head plate is coupled to the body 109 such as by thermal fusion, sonic welding, adhesion, fasteners, or the like.

In AMR, the handle is formed integrally with the head plate as a one-piece structure. After the handle and the head plate are formed, the bristles are inserted into holes in the head plate so that the free/cleaning ends of the bristles extend from the front surface of the head plate and the bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte/thin layer of plastic. In some embodiments, after formation of the melt matte, a tissue cleanser is injection molded onto the rear surface of the head plate, thereby trapping the melt matte between the tissue cleanser and the rear surface of the head plate. In other embodiments, other structures may be coupled to the rear surface of the head plate to trap the melt matte between the rear surface of the head plate and such structure without the structure necessarily being a tissue cleanser (the structure can just be a plastic material that is used to form a smooth rear surface of the head, or the like).

Of course, techniques other than AFT and AMR can be used for mounting the tooth cleaning elements 115 to the head portion 110, such as widely known and used stapling techniques or the like. In such embodiments the head plate 130 may be omitted and the tooth cleaning elements 115 may be coupled directly to the head portion 110 by folding the tooth cleaning elements into a U-shape, inserting the bight of the U-shape into tuft holes in the head, and then inserting a staple into the tuft holes. Furthermore, in a further modified version of the AFT and AMR processes discussed above, the head plate 130 may be formed by positioning the tooth cleaning elements 115 within a mold, and then molding the head plate 130 around the tooth cleaning elements 115 via an injection molding process.

Still referring to FIG. 1, the oral care implement 100 also comprises an elastomeric element 150 extending from the handle portion 120 of the body 109. In the exemplified embodiment, the elastomeric element 150 is located at or adjacent to the proximal end 101 of the body 109 (which is also the proximal end of the handle portion 120) and the head portion 110 is coupled to the distal end 103 of the handle portion 120. However, the invention is not to be so limited and the elastomeric element 150 can be positioned at other locations along the handle portion 120 of the body 109. For example, although in the exemplified embodiment the elastomeric element 150 is located on the front surface 104 of the handle portion 120, in other embodiments the elastomeric element 150 may be located on the rear surface 105 of the handle portion 120. Furthermore, in other embodiments the elastomeric element 150 may be located at any position along the body 109 without being limited to the handle portion 120. Specifically, in some embodiments the oral care implement 100 may not include tooth cleaning elements, but instead the elastomeric element 150 may be coupled to the head 120 of the oral care implement 100. Thus, in certain embodiments the invention may be directed to an oral care implement having the body 109 with the elastomeric element 150 extending therefrom. In some embodiments, tooth cleaning elements or other oral care hygiene features (such as filaments used as floss, tongue scrapers or cleaners, or the like) may be located on a first surface of the head portion 120 and the elastomeric element 150 may be located on a second opposite surface of the head portion 120. In other embodiments one of the oral hygiene features other than tooth cleaning elements may be located on the head portion 120 while the elastomeric element 150 is located on the handle portion 110.

The elastomeric element 150 may be used as a stimulator tip in an oral hygiene cleaning process. In that regard, the elastomeric element 150 is formed of a resilient elastomeric material, such as a thermoplastic elastomer, rubber, or the like. The elastomeric element 150 may be used for oral hygiene by contacting a user's gums with the elastomeric element 150 to remove plaque from around the gum line and for stimulating blood flow to the gums. Specifically, the elastomeric element 150 may be used by gently tracing the outer and inner gum line with the elastomeric element 150 (or a distal tip thereof), which will remove plaque and stimulate blood flow.

Figure 2:
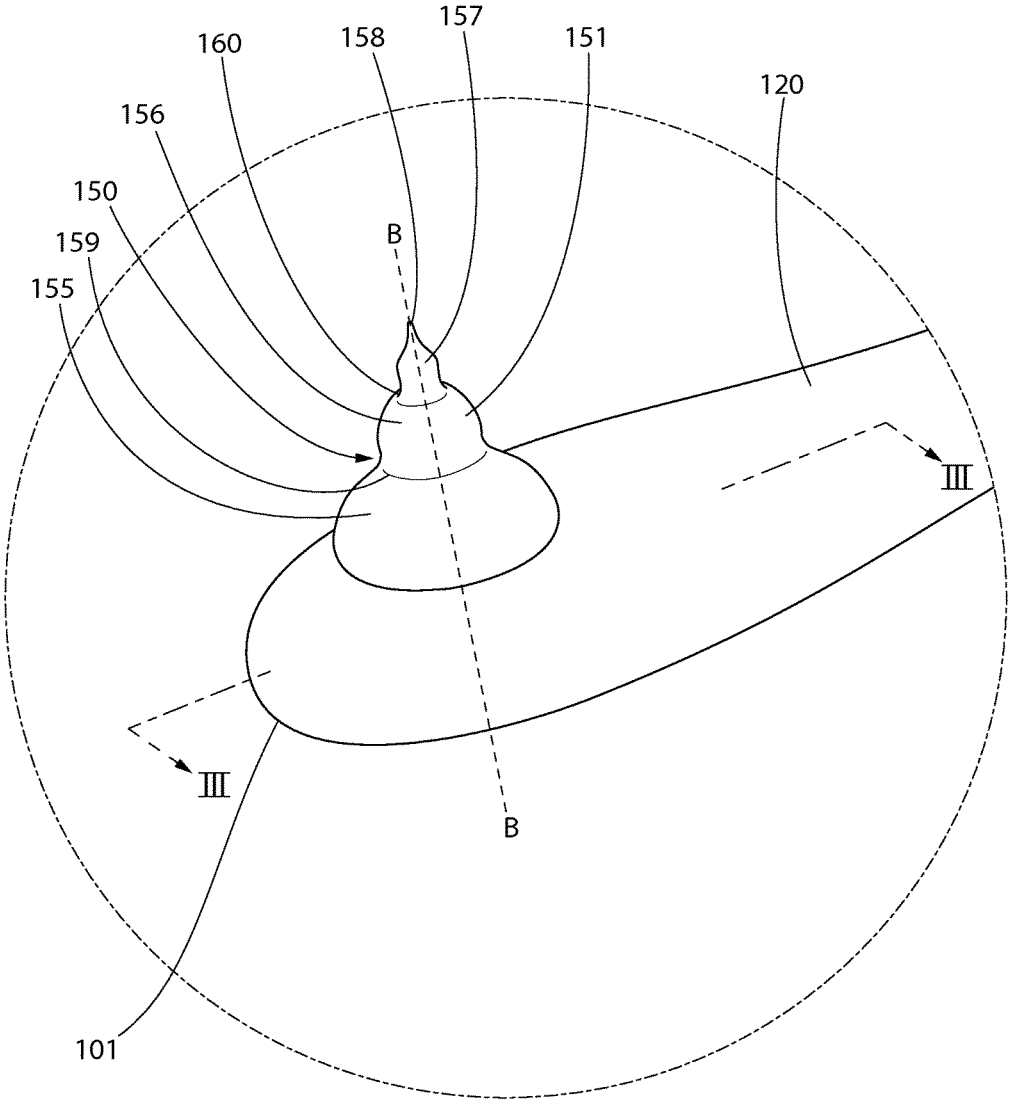
FIG. 2 is a close-up view of area II of FIG. 1, wherein the elastomeric element is in a normal state.
Figure 3:
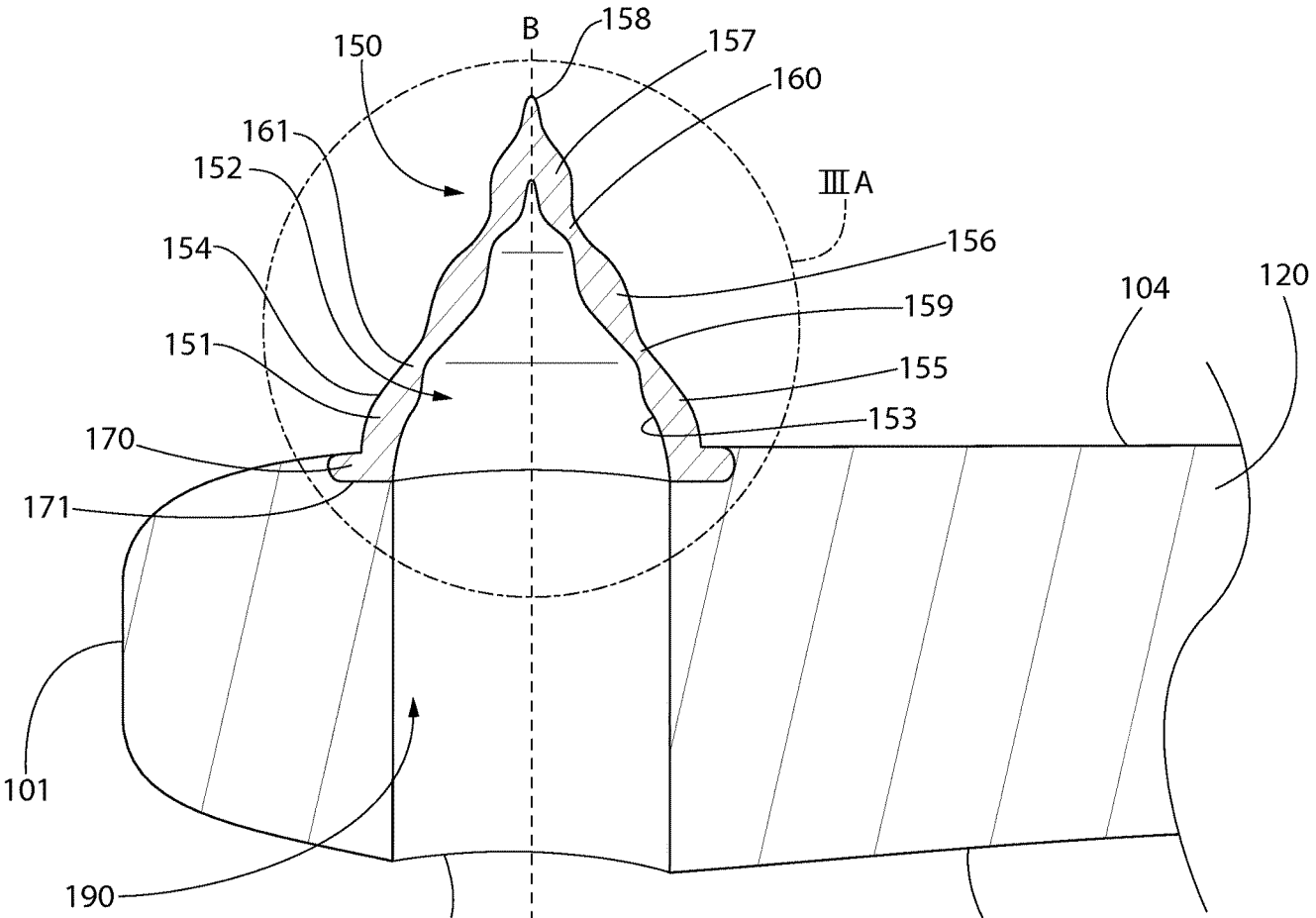
FIG. 3 is a cross-sectional view taken along line III-III of FIG. 2.
Figure 3A:
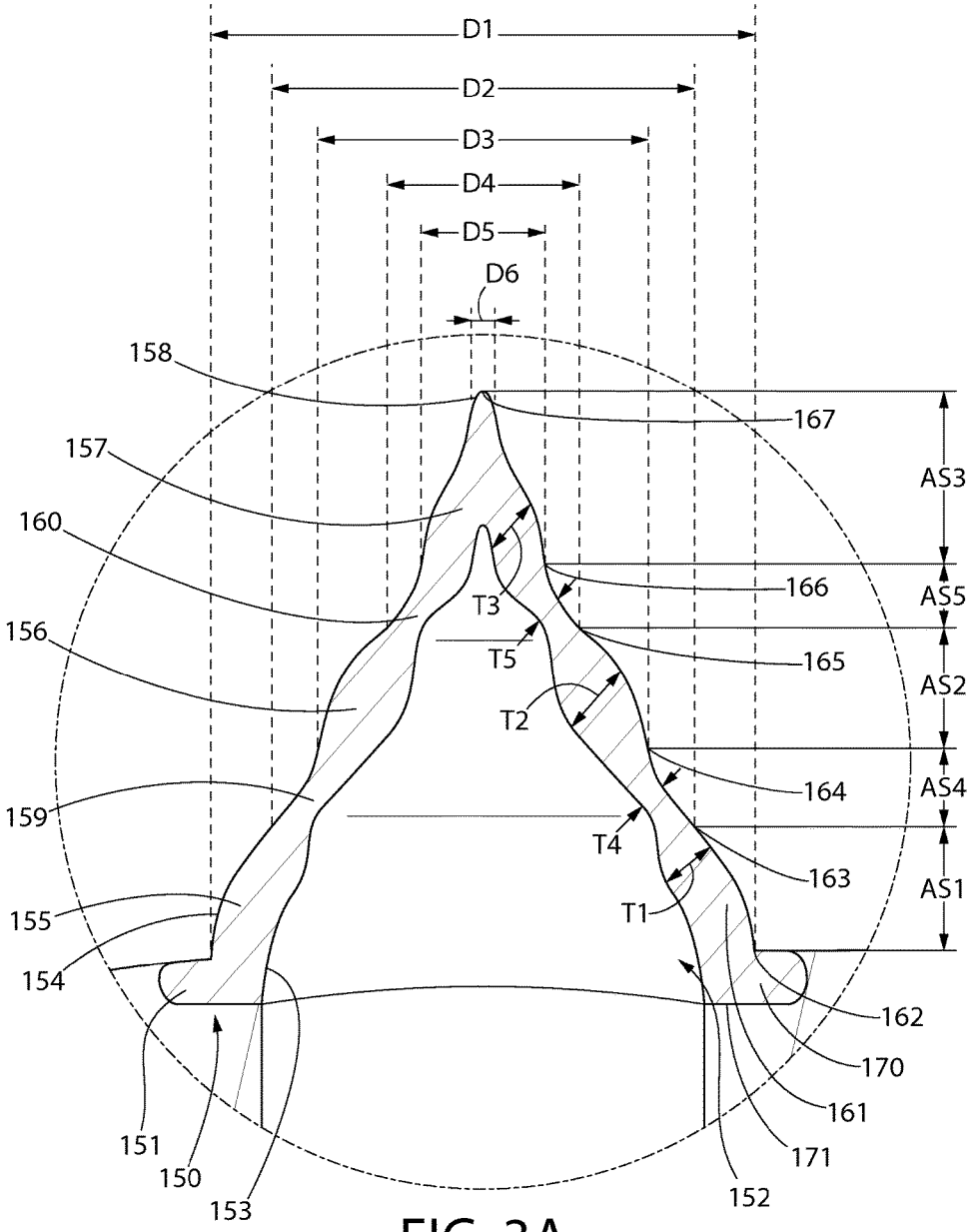
FIG. 3A is a close-up view of area IIIA of FIG. 3.

Referring now to FIGS. 2, 3, and 3A concurrently, the elastomeric element 150 will be described when it is in a normal or non-collapsed state. Specifically, the elastomeric element 150 is capable of transitioning between the normal state depicted in FIGS. 2, 3, and 3A and a collapsed state depicted in FIGS. 5 and 6. The specific structure of the elastomeric element 150 in each of the normal and collapsed states as well as the various manners in which the elastomeric element 150 can be transitioned between the normal and collapsed states will be discussed in more detail below.

The elastomeric element 150 comprises a hollow body 151 that defines an internal cavity 152. Specifically, the hollow body 151 of the elastomeric element 150 has an inner surface 153 and an opposing outer surface 154. The inner surface 153 of the hollow body 151 forms the bounds of the internal cavity 152 of the hollow body 151. The hollow body 151 comprises a base section 155 that is coupled directly to the body 109 of the oral care implement 100, a middle section 156, and a distal section 157. The middle section 156 is located between the base section 155 and the distal section 157. Furthermore, the hollow body 151 terminates in a free distal tip 158, and the distal section 157 comprises the free distal tip 158.

A lower portion 170 of the hollow body 151 extends into the body 109 of the oral care implement 100 in order to mount/couple the elastomeric element 150 to the body 109. In certain embodiments, the base section 155 of the hollow body 109 may comprise the lower portion 170 of the hollow body 151. The lower portion 170 of the hollow body 151 terminates in a bottom surface 171. The hollow body 151 extends from the bottom surface 171 of the lower portion to the distal tip 158 along a central axis B-B. Despite comprising the base section 155, the middle section 156, and the distal section 157 (and also the lower portion 170), in the exemplified embodiment the hollow body 151 is integrally formed as a single component. Thus, the hollow body 151 of the elastomeric component 150 is a single unitary monolithic structure. Thus, if the hollow body 151 is formed during an injection molding process, the hollow body 151 is formed in a single shot. In certain embodiments each of the base section 155, the middle section 156, and the distal section 157 may be formed of a different color to create a desired aesthetic for the elastomeric element 150.

In addition to the base section 155, the middle section 156, the distal section 157, and the lower portion 170, the hollow body 151 also comprises one or more pre-weakened sections. Specifically, in the exemplified embodiment the hollow body 151 comprises a first pre-weakened section 159 and a second pre-weakened section 160. The first pre-weakened section 159 is located between the base section 155 and the middle section 156. The second pre-weakened section 160 is located between the middle section 156 and the distal section 157. When the elastomeric element 150 is in the normal state as depicted in FIGS. 1-3A, the middle section 156 axially extends from the base section 155 and the distal section 157 axially extends from the middle section 156.

The first and second pre-weakened sections 159, 160 of the elastomeric element 150 facilitate the transition of the elastomeric element 150 between the normal and collapsed states. Specifically, the elastomeric element 150 is able to fold into itself about the first and second pre-weakened areas 159, 160 in order to achieve the collapsed state and to extend without being folded about the first and second pre-weakened areas 159, 160 in the normal state. As will be discussed in more detail below, in the exemplified embodiment the first and second pre-weakened areas 159, 160 are formed by thinned sections of the elastomeric element 150. Specifically, the wall of the elastomeric element 150 is thinner at the first and second pre-weakened areas 159, 160 than at the other regions (i.e., at the base, middle, and distal sections 155, 156, 157). However, the invention is not to be limited to the first and second pre-weakened areas 159, 160 being formed by thinned sections of the elastomeric element in all embodiments. Specifically, in other embodiments the first and second pre-weakened areas 159, 160 may be formed by a series of perforations, a scored area, forming the first and second pre-weakened areas 159, 160 from a material that is different than the remainder of the elastomeric element 150 (possibly with a lower durometer value to make the area of the first and second pre-weakened areas 159, 160 more flexible), or the like. Thus, the first and second pre-weakened areas 159, 160 can be formed in a wide variety of manners, including without limitation, scoring, perforating, thinning, pre-creasing, combinations thereof, and/or otherwise altering the integrity of the elastomeric element 150 in a controlled and targeted manner through the use of chemical energy, thermal energy, mechanical energy, or combinations thereof.

In the exemplified embodiment, the hollow body 151 comprises a conical wall 161 that is formed of a resilient material. Furthermore, the conical wall 161 is a continuous solid wall in the shape of a cone that is free of any apertures or holes therein. Of course, in other embodiments the conical wall 161 may have some small holes or apertures as desired to achieve greater air flow through the elastomeric element 150 and for aesthetic purposes. The base section 155 comprises a first annular section AS1 of the conical wall 161, the middle section 156 comprises a second annular section AS2 of the conical wall 161, the distal section 157 comprises a third annular section AS3 of the conical wall 161, the first pre-weakened section 159 comprises a fourth annular section AS4 of the conical wall 161, and the second pre-weakened section 160 comprises a fifth annular section AS5 of the conical wall 161.

Each of the annular sections of the conical wall 161 is a section of the conical wall 161 that includes an entire circumferential portion of the conical wall 161 for a specific axial section or length of the conical wall 161. Thus, the base section 155 axially extends from the body 109, the first pre-weakened section 159 axially extends from the base section 155, the middle section 156 axially extends from the first pre-weakened section 159, the second pre-weakened section 160 axially extends from the middle section 156, and the distal section 157 axially extends from the second pre-weakened section 160 heading in a direction away from the body 109. In the exemplified embodiment, each of the base, middle, and distal sections 155, 156, 157 has a greater axial length than each of the first and second pre-weakened sections 159, 160. However, the specific axial length of each of the base, middle, and distal sections 155, 156, 157 and each of the first and second pre-weakened sections 159, 160 is not to be limiting of the present invention in all embodiments.

The first annular section AS1 of the conical wall 161 has a lower end 162 and an upper end 163. The lower end 162 of the first annual section AS1 of the conical wall 161 has a first diameter D1 and the upper end 163 of the first annular section AS1 of the conical wall 161 has a second diameter D2, the second diameter D2 being less than the first diameter D1.

The second annular section AS2 of the conical wall 161 has a lower end 164 and an upper end 165. The lower end 164 of the second annular section AS2 of the conical wall 161 has a third diameter D3 and the upper end 165 of the second annular section AS2 of the conical wall 161 has a fourth diameter D4, the fourth diameter D4 being less than the third diameter. Furthermore, in the exemplified embodiment the third diameter D3 is less than the second diameter D2, but in other embodiments the third diameter D3 may be the same as the second diameter D2. Thus, the third diameter D3 may be equal to or less than the second diameter D2.

The third annular section AS3 of the conical wall 161 has a lower end 166 and an upper end 167. The lower end 166 of the third annular section AS3 of the conical wall 161 has a fifth diameter D5 and the upper end 167 of the third annular section AS3 of the conical wall 161 has a sixth diameter D6, the sixth diameter D6 being less than the fifth diameter D5. Furthermore, in the exemplified embodiment the fifth diameter D5 is less than the fourth diameter D4, but in other embodiments the fifth diameter D5 may be the same as the fourth diameter D4. Thus, the fifth diameter D5 may be equal to or less than the fourth diameter D4. The upper end 167 of the third annular section AS3 comprises the free distal tip 158 of the hollow body 151.

Due to the decreasing diameters of the conical wall 161 of the hollow body 151 as the hollow body 151 extends further from the body 109 of the oral care implement 100, in certain embodiments the elastomeric element 150 has an outer transverse cross-sectional profile that never increases in size moving from the lower end 162 of the first annular section AS1 (also the lower end of the base section 155) to the free distal tip 158 (best seen in FIG. 3A). In certain embodiments, the outer transverse cross-sectional profile of the elastomeric component 150 is constantly decreasing in size from the lower end 162 of the first annular section AS1 to the free distal tip 158, although the slope of the decrease may not be continuous in all embodiments.

The upper end 163 of the first annular section AS1 of the conical wall 161 is connected to the lower end 164 of the second annular section AS2 of the conical wall 161 by the first pre-weakened section 159. Thus, the first pre-weakened section 159 is located in between the first annular section AS1 and the second annular section AS2. The first annular section AS1 has a first wall thickness T1, the second annular section AS2 has a second wall thickness T2, and the fourth annular section AS4 that is formed by the first pre-weakened section 159 has a fourth wall thickness T4. Each of the wall thicknesses T1, T2, T4 may be constant within its respective section, although in the exemplified embodiment the wall thicknesses T1, T2, T4 are non-constant within the respective sections. Nonetheless, in the exemplified embodiment the minimum value of the first and second wall thicknesses T1, T2 is greater than the maximum value of the fourth wall thickness T4.

As exemplified, the fourth wall thickness T4 of the fourth annular section AS4 is less than each of the first and second wall thicknesses T1, T2 of the first and second annular wall sections AS1, AS2. Thus, as noted above, in the exemplified embodiment the first pre-weakened area 159 that forms the fourth annular section AS4 of the elastomeric element 150 is a thinned section of the elastomeric element 150 relative to the areas of the elastomeric element 150 that are adjacent to the first pre-weakened area 159 (i.e., relative to the first and second annular sections AS1, AS2 of the elastomeric element 150). In certain embodiments, the first and second wall thicknesses T1, T2 are the same, although the invention is not to be so limited and the first and second wall thicknesses T1, T2 can be different in other embodiments. Due to the reduced thickness of the fourth annular section AS4 of the conical wall 161 relative to the first and second annular sections AS1, AS2 of the conical wall 161, the first pre-weakened section 159 forms a living hinge between the first and second annular sections AS1, AS2 of the conical wall 161. The living hinge formed by the first pre-weakened section 159 facilitates the transition of the elastomeric element 150 between the normal and collapsed states and permits bending of the elastomeric component 150 at the location of the first pre-weakened section 159, as discussed in more detail below.

The upper end 165 of the second annular section AS2 of the conical wall 161 is connected to the lower end 166 of the third annular section AS3 of the conical wall 161 by the second pre-weakened section 160. Thus, the second pre-weakened section 160 is located in between the second annular section AS2 and the third annular section AS3. As noted above, the second annular section AS2 has the second wall thickness T2. Furthermore, the third annular section AS3 has a third wall thickness T3, and the fifth annular section AS5 that is formed by the second pre-weakened section 160 has a fifth wall thickness T5. Each of the wall thicknesses T2, T3, T5 may be constant within its respective section, although in the exemplified embodiment the wall thicknesses T2, T3, T5 are non-constant within the respective sections. Nonetheless, in the exemplified embodiment the minimum value of the second and third wall thicknesses T2, T3 is greater than the maximum value of the fifth wall thickness T5.

As exemplified, the fifth wall thickness T5 of the fifth annular section AS5 is less than each of the second and third wall thicknesses T2, T3 of the second and third annular wall sections AS2, AS3. Thus, as noted above, in the exemplified embodiment the second pre-weakened area 160 that forms the fifth annular section AS5 of the elastomeric element 150 is a thinned section of the elastomeric element 150 relative to the areas of the elastomeric element 150 that are adjacent to the second pre-weakened area 160 (i.e., relative to the second and third annular sections AS1, AS2 of the elastomeric element 150). In certain embodiments, the second and third wall thicknesses T2, T3 are the same, although the invention is not to be so limited and the second and third wall thicknesses T2, T2 can be different in other embodiments. Due to the reduced thickness of the fifth annular section AS5 of the conical wall 161 relative to the second and third annular sections AS2, AS3 of the conical wall 161, the second pre-weakened section 160 forms a living hinge between the second and third annular sections AS2, AS3 of the conical wall 161. The living hinge formed by the second pre-weakened section 160 facilitates the transition of the elastomeric element 150 between the normal and collapsed states and permits bending of the elastomeric component 150 at the location of the second pre-weakened section 160, as discussed in more detail below.

Thus, the first pre-weakened section 159 comprises the fourth annular section AS4 which has a reduced thickness compared to the adjacent sections of the conical wall 161, specifically the first and second sections AS1, AS2 of the conical wall 161. Similarly, the second pre-weakened section 160 comprises the fifth annular section AS5 of the conical wall 161 which has a reduced thickness compared to the adjacent sections of the conical wall 161, specifically the second and third sections AS2, AS3 of the conical wall 161.

Figure 5:
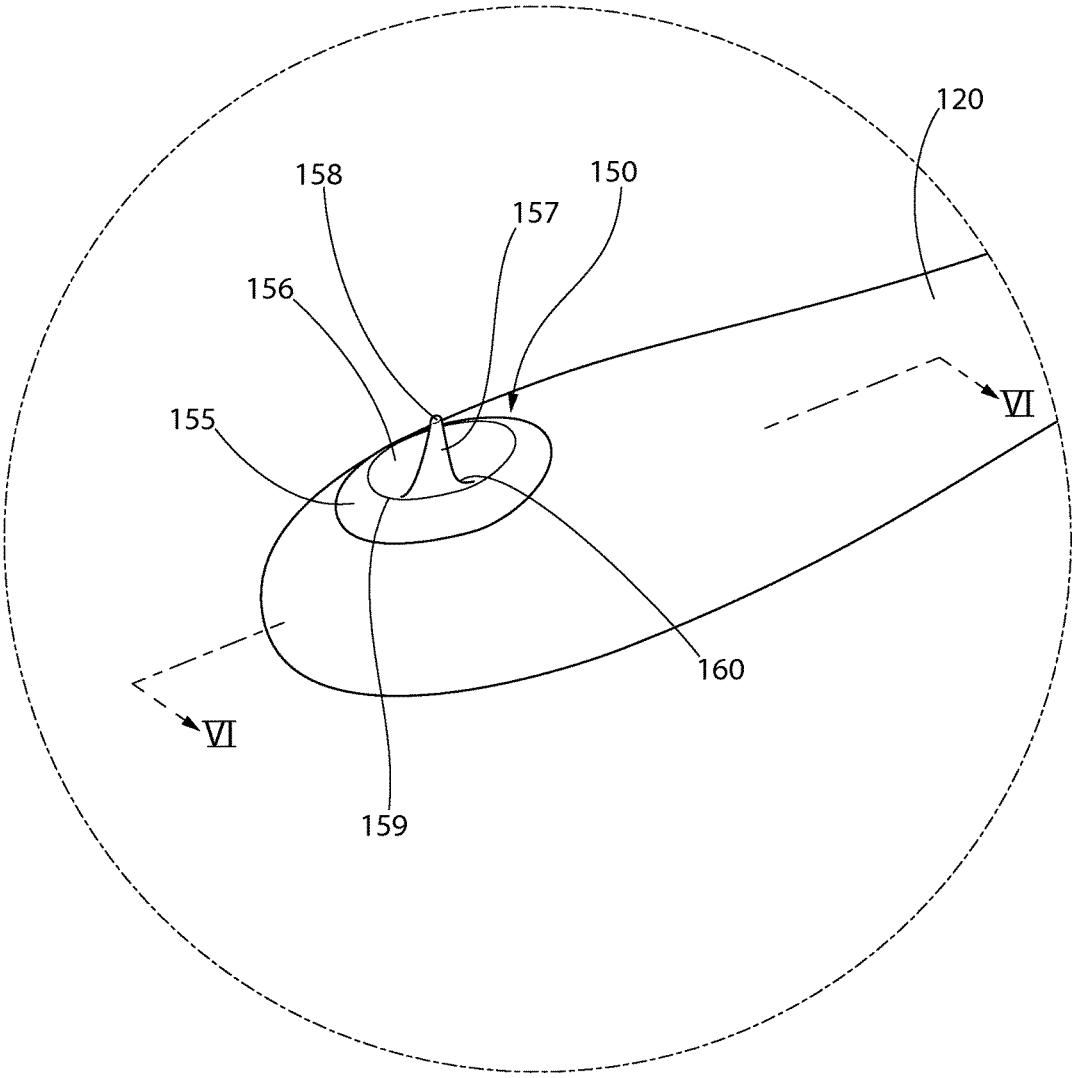
FIG. 5 is a close-up view of area II of FIG. 1, wherein the elastomeric element is in a collapsed state.
Figure 6:
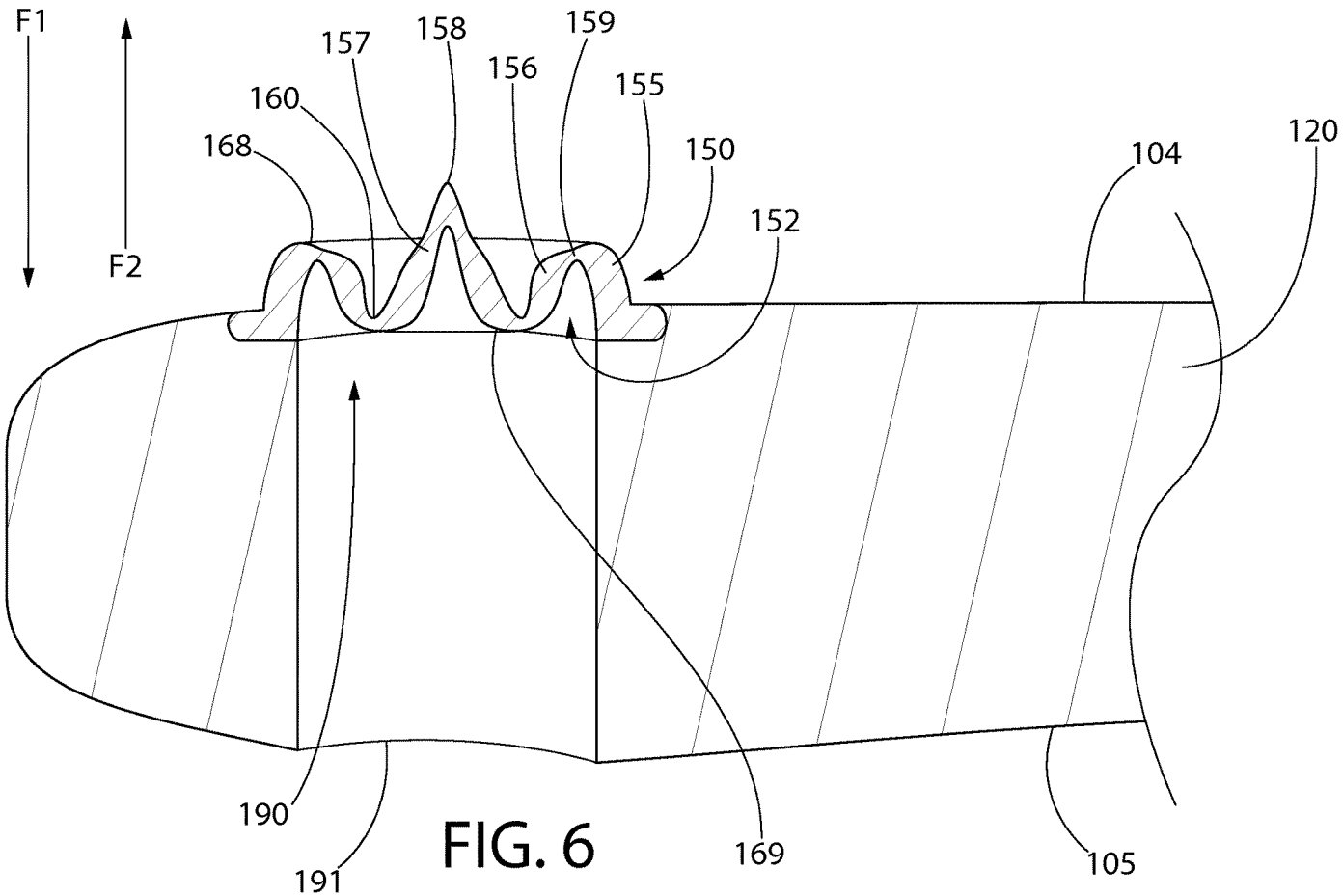
FIG. 6 is a cross-sectional view taken along line VI-VI of FIG. 5.

Referring to FIGS. 3 and 3A, in the exemplified embodiment the body 109 of the oral care implement 100 has a bore 190 formed therein. Specifically, in this embodiment the bore 190 extends through the handle portion 120 of the body 109 from the front surface 104 of the handle portion 120 to the rear surface 105 of the handle portion 120. As will be appreciated from the discussion of the elastomeric element 150 in the collapsed state as illustrated in FIGS. 5 and 6, the bore 190 provides a location within the body 109 for the elastomeric element 150 to collapse into. Furthermore, because in FIG. 3 the bore 190 extends entirely through the handle portion 120, an opening 191 is formed into the bore 190 at the rear surface 105 of the handle portion 120. The opening 191 at the rear surface 105 of the handle portion 120 forms a vent aperture that is in communication with the bore 190. The vent aperture/opening 191 enables air to enter into and leave the internal cavity 152 of the hollow body 151 during transition of the elastomeric element 150 between the normal and collapsed states.

Figure 4:
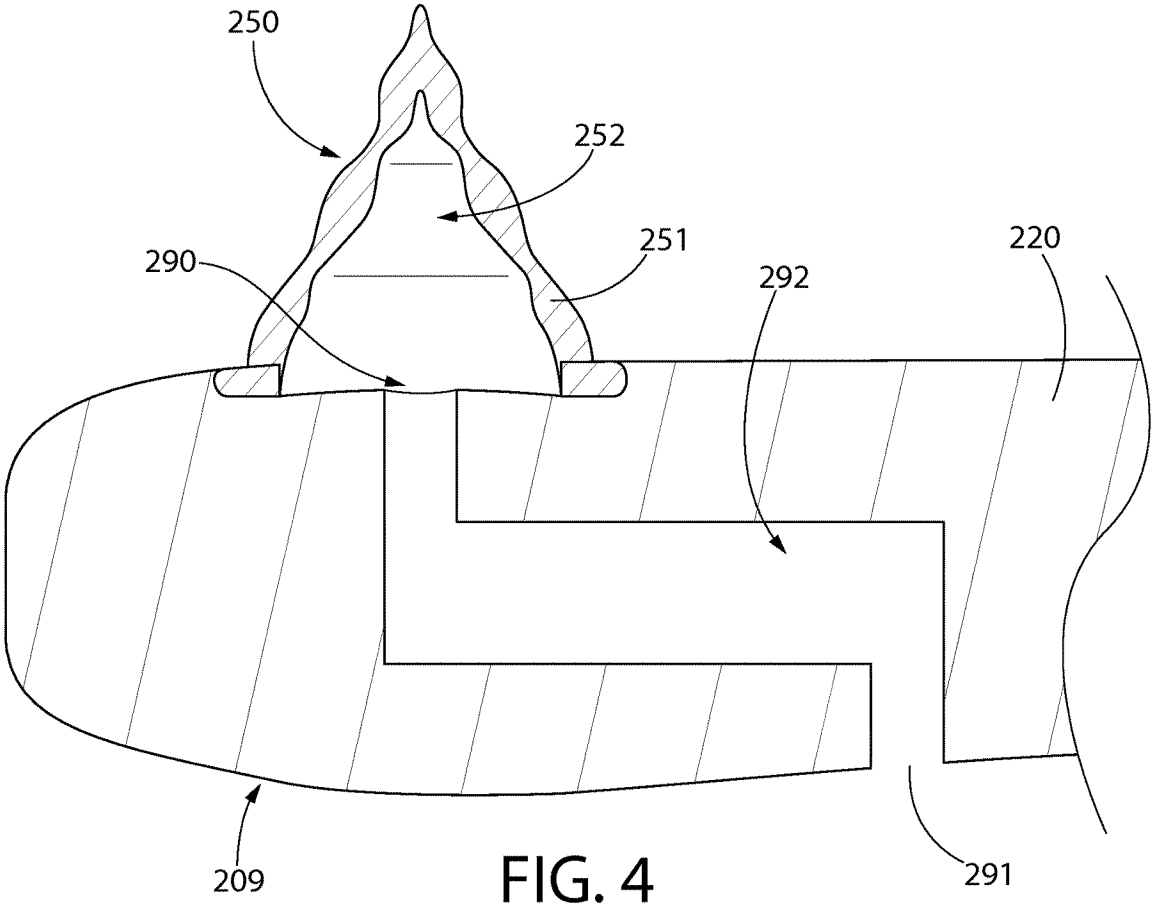
FIG. 4 is an alternative cross-sectional view taken along line III-III of FIG. 2.

Referring briefly to FIG. 4, an alternative arrangement for a bore 290 and a vent aperture 291 is illustrated. Specifically, in FIG. 4 a passageway 292 extends through the handle portion 220 in the direction of the head portion (not illustrated) from the bore 290 to the vent aperture 291. Thus, the embodiment of FIG. 4 exemplifies that the vent aperture 191, 291 can be positioned at any location along the body 109, 209 as desired so long as the vent aperture 191, 291 is in fluid communication with the bore 190, 290 to permit air to enter and exit the internal cavity 152, 252 of the hollow body 251 during transition of the elastomeric element 150, 250 between the normal and collapsed states.

Referring now to FIGS. 5 and 6 concurrently, the elastomeric element 150 will be described when positioned in the collapsed state. In certain embodiments, a first axial force F1 is applied to the distal tip 158 of the elastomeric element 150 in a first axial direction in order to transition the elastomeric element 150 from the normal state (depicted in FIGS. 2 and 3) to the collapsed state (depicted in FIGS. 5 and 6). The first axial direction is towards the handle portion 120 of the body 109 of the oral care implement 100. In some embodiments, the elastomeric element 150 may be self-biased into the normal state so that during application of the first axial force F1 in the first axial direction, the elastomeric element 150 transitions into the collapsed state. However, in such embodiments, upon the cessation of the first axial force F1 in the first axial direction, the elastomeric element 150 will automatically transition back from the collapsed state into the normal state. This is achieved in the self-biased embodiment because the elastomeric element 150 is configured to always be in the normal state unless the first axial force F1 is actively being applied to the elastomeric element 150 in the first axial direction.

In other embodiments, the elastomeric element 150 may not have a self-bias, but may instead remain in either of the normal or collapsed states until a force is applied to the elastomeric element 150. Specifically, in one embodiment the elastomeric element 150 will start in the normal state, and when the elastomeric element 150 is in the normal state it will remain in that state until the first axial force F1 is applied onto the free distal tip 158 in the first axial direction towards the handle portion 120. Upon applying the first axial force F1 to the free distal tip 158 of the elastomeric element 150, the elastomeric element 150 will transition into the collapsed state of FIGS. 5 and 6. In this embodiment, even after cessation of the first axial force F1 in the first axial direction, the elastomeric element 150 will remain in the collapsed state. Thus, in this embodiment a second axial force F2 in a second axial direction is required to be applied to the elastomeric element 150 in order to transition the elastomeric element 150 from the collapsed state to the normal state. The second axial direction may be a direction away from the handle portion 120, and may be opposite the first axial direction.

This non-biasing embodiment may be useful if it is desirable to tuck away the free distal end 158 of the elastomeric element 150 during use of the oral care implement 100 for toothbrushing (and other oral hygiene activities). Specifically, because the user grips the handle portion 120 of the oral care implement 100 during toothbrushing and other oral hygiene activities, if the elastomeric element 150 is located on the handle portion 120 it may dig into the user's palm during toothbrushing. By being able to fold the elastomeric element 150 into the collapsed state, the extension of the free distal tip 158 of the elastomeric element 150 beyond the outer surface of the handle portion 120 is reduced or may even be eliminated. Furthermore, this can be useful as a training tool to teach a user not to contact the elastomeric element 150 to the user's gums with too much force. Specifically, if a user is using too much force, the elastomeric element 150 will transition into the collapsed state, at which time the user may no longer be able to contact the elastomeric element 150 to his or her gums because the distal tip 158 of the elastomeric element 150 may be recessed within the bore 190 of the handle portion 120. Thus, the user will have to apply the second axial force F2 to the elastomeric element 150 in order to continue using the elastomeric element 150, and will likely do so with a lesser force having learned that the excessive force will result in collapsing of the elastomeric element 150.

Regardless of whether the elastomeric element 150 remains in the state that it is placed into until a force is applied or if the elastomeric element 150 has a self-bias into one of the normal and collapsed states, the structure of the elastomeric element 150 when it is in the collapsed state is the same. Specifically, when the elastomeric element 150 is in the collapsed state, the middle section 156 of the hollow body 151 collapses into the internal cavity 152 so as to be at least partially surrounded by the base section 155 of the hollow body 151. Specifically, to achieve this structure, the hollow body 151 bends or folds along or about the first pre-weakened area 159 so that the middle section 156 extends into the internal cavity 152 so as to be surrounded by the base section 155. The combination of the base section 155 and the middle section 156 forms a U-shape with a bight portion 168 of the U forming a convex surface that faces away from the handle portion 120.

At the same time, the distal section 157 of the hollow body 151 collapses into the internal cavity 152 so as to be at least partially surrounded by the middle section 156 of the hollow body 151. Specifically, to achieve this structure, the hollow body 151 bends or folds along or about the second pre-weakened area 160 so that the distal section 157 extends into the internal cavity 152 so as to be surrounded by the middle section 156 and by the base section 155. The combination of the middle section 156 and the distal section 157 forms a U-shape with a bight portion 169 of the U forming a convex surface that faces toward the handle portion 120.

Although noted above as being simultaneous, in some embodiments upon application of the first axial force F1, the distal section 157 of the hollow body 151 may collapse into the internal cavity 152 so as to be surrounded by the middle section 156 of the hollow body 151. However, a force greater than the first axial force may be required to then collapse the middle section 156 of the hollow body 151 into the base section 155 of the hollow body 151. Alternatively, the middle section 156 may first collapse into the internal cavity 152 so as to be surrounded by the base section 155 without the distal section 157 also collapsing. The strength or thickness of each of the first and second pre-weakened sections 159, 160 may dictate the order of the collapse of the various sections of the elastomeric element 150.

In the exemplified embodiment, in the collapsed state the middle section 156 of the hollow body 151 is at least partially located within the bore 190 that is formed into the handle portion 120 of the body 109. Similarly, the distal section 157 is also at least partially located within the bore 190 that is formed into the handle portion 120 of the body 109. Furthermore, in the exemplified embodiment in the collapsed state the base section 155 of the hollow body 151 at least partially protrudes from the handle portion 120 of the body 109. Moreover, in the exemplified embodiment in the collapsed state the free distal tip 158 of the distal section 157 axially protrudes from and extends beyond the base section 155, the middle section 156, and the bight portion 168.

Thus, in the exemplified embodiment the free distal tip 158 remains accessible for contacting a user's teeth and gums even when it is in the collapsed state. However, the invention is not to be so limited in all embodiments. Rather, in certain other embodiments when the elastomeric element 150 is in the collapsed state, the free distal tip 158 of the elastomeric element 150 may be surrounded by one or both of the middle section 156 and the base section 155 of the elastomeric element 150 so that no portion of the distal section 157 of the elastomeric element 150 protrudes beyond the base and/or middle sections 155, 156 of the elastomeric element 150. Stated another way, the free distal tip 158 may be recessed beneath one or more of the front surface 104 of the handle portion 120, the middle section 156 of the elastomeric component 150, or the base section 155 of the elastomeric component 150 when the elastomeric component 150 is in the collapsed state. This may increase user comfort when handling the oral care implement 100 during toothbrushing as has been discussed above by ensuring that the distal tip 158 will not rub against the user's palm during toothbrushing.

Furthermore, by forming the elastomeric element 150 so that it collapses in response to application of the first axial force F1, this reduces the likelihood of the user damaging his or her gums when using the elastomeric element 150. As noted above, the elastomeric element 150 is used by contacting the user's gumline with the distal tip 158 of the elastomeric element 150. The user is not supposed to apply a great deal of force onto the gumline with the distal tip 158, but rather just gently move the distal tip 158 of the elastomeric element 150 along the gumline. If the user applies too much force, the elastomeric element 150 will collapse upon itself as described herein. This collapsing action will both provide an indication to the user that he or she is using too much force, and will also potentially prevent the user from continuing to contact the gumline with the distal tip 158 once the elastomeric element 150 has collapsed.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a body;

an elastomeric element extending from the body and terminating in a free distal tip, the elastomeric element comprising a hollow body defining an internal cavity, the hollow body extending along a central axis;

the hollow body comprising a base section coupled to the body, a distal section comprising the free distal tip, and at least one middle section located between the base and distal sections;

each of the base, middle, and distal sections coupled to one another by a pre-weakened section, the elastomeric element configured to alternate between: (1) a collapsed state in which the middle section collapses into the internal cavity so as to be at least partially surrounded by the base section and the distal section collapses into the internal cavity so as to be at least partially surrounded by the middle section upon the application of an axial force to the free distal tip in a first axial direction toward the body; and (2) a normal state in which the middle section axially extends from the base section and the distal section axially extends from the middle section upon cessation of the axial force; and wherein in the collapsed state, the middle section and the distal section are at least partially located within a bore formed in the body.

2. The oral care implement according to claim 1 wherein the hollow body is an integrally formed singular component.

3. The oral care implement according to claim 1 wherein the body comprises a handle portion and a head portion, a plurality of tooth cleaning elements extending from the head portion of the body, and wherein the elastomeric element is located at a proximal end of the handle portion of the body, the head portion coupled to a distal end of the handle portion of the body.

4. The oral care implement according to claim 1 wherein the hollow body comprises a conical wall formed of a resilient material.

5. The oral care implement according to claim 4 further comprising:

the base section comprising a first annular section of the conical wall, the first annular section of the conical wall having a lower end having a first diameter and an upper end having a second diameter that is less than the first diameter;

the middle section comprising a second annular section of the conical wall, the second annular section of the conical wall having a lower end having a third diameter that is less than or equal to the second diameter and an upper end having a fourth diameter that is less than the third diameter; and the distal section comprising a third annular section of the conical wall, the third annular section of the conical wall having a lower end having a fifth diameter that is less than or equal to the fourth diameter and an upper end comprising the free distal tip that has a sixth diameter that is less than fifth diameter.

6. The oral care implement according to claim 5 wherein the upper end of the first annular section of the conical wall is connected to the lower end of the second annular section of the conical wall by a first one of the pre-weakened sections; and wherein the upper end of the second annular section of the conical wall is connected to the lower end of the third annular section of the conical wall by a second one of the pre-weakened sections.

7. The oral care implement according to claim 6 wherein the first one of the pre-weakened sections comprises a fourth annular section of the conical wall having a reduced thickness compared to each of the first and second annular sections of the conical wall; and wherein the second one of the pre-weakened sections comprises a fifth annular section of the conical wall having a reduced thickness compared to each of the second and third annular sections of the conical wall.

8. The oral care implement according to claim 4 wherein each of the pre-weakened sections comprise an annular wall section of reduced thickness compared to adjacent sections of the conical wall.

9. The oral care implement according to claim 4 wherein the conical wall is free of apertures.

10. The oral care implement according to claim 1 wherein the elastomeric element is self-biased into the normal state.

11. An oral care implement comprising:

a body comprising a handle portion and a head portion;

an elastomeric element extending from the body and terminating in a free distal tip, the elastomeric element comprising a hollow body formed of a resilient material and defining an internal cavity, the hollow body extending along a central axis;

the hollow body comprising a base section coupled to the body, a distal section comprising the free distal tip, and at least one middle section located between the base and distal sections;

each of the base, middle, and distal sections coupled to one another by a pre-weakened section, the elastomeric element configured to alternate, in response to application and cessation of an axial force, between: (1) a collapsed state in which the middle section collapses into the internal cavity so as to be at least partially surrounded by the base section and the distal section collapses into the internal cavity so as to be at least partially surrounded by the middle section; and (2) a normal state in which the base, middle, and distal sections collectively form a conical structure; and wherein in the collapsed state, the middle section and the distal section are at least partially located within a bore formed in the body.

12. The oral care implement according to claim 11 wherein the hollow body is an integrally formed singular component.

13. The oral care implement according to claim 11 wherein the elastomeric element is free of apertures.

14. The oral care implement according to claim 11 further comprising:

the base section having a lower end having a first diameter and an upper end having a second diameter that is less than the first diameter;

the middle section comprising a lower end having a third diameter that is less than or equal to the second diameter and an upper end having a fourth diameter that is less than the third diameter; and the distal section comprising a lower end having a fifth diameter that is less than or equal to the fourth diameter and an upper end comprising the free distal tip that has a sixth diameter that is less than fifth diameter.

15. An oral care implement comprising:

a body;

an elastomeric element extending from the body and terminating in a free distal tip, the elastomeric element comprising a hollow body formed of a resilient material and defining an internal cavity, the hollow body extending along a central axis;

the hollow body comprising a base section coupled to the body, a distal section comprising the free distal tip, and at least one middle section located between the base and distal sections;

each of the base, middle, and distal sections coupled to one another by a pre-weakened section, the elastomeric element configured to alternate between: (1) a collapsed state in which the middle section collapses into the internal cavity so as to be at least partially surrounded by the base section and the distal section collapses into the internal cavity so as to be at least partially surrounded by the middle section; and (2) a normal state in which the base, middle, and distal sections collectively form a conical structure; and wherein in the collapsed state, the middle section and the distal section are at least partially located within a bore formed in the body.

16. The oral care implement according to claim 15 wherein when the elastomeric element is in the normal state, the elastomeric element remains in the normal state until an axial force is applied to the elastomeric element in a first axial direction, and wherein when the elastomeric element is in the collapsed state, the elastomeric element remains in the collapsed state until an axial force is applied to the elastomeric element in a second axial direction, the first axial direction being opposite the second axial direction.

17. The oral care implement according to claim 15 wherein an axial force in a direction away from the body is required to transition the elastomeric element from the collapsed state to the normal state.

* * * * *